US008097322B1

(12) United States Patent
Osorio

(10) Patent No.: US 8,097,322 B1
(45) Date of Patent: Jan. 17, 2012

(54) PAPER PRODUCT

(76) Inventor: Adina M. Osorio, Paramount, CA (US)

( * ) Notice: Subject to any disclaimer, the term of this patent is extended or adjusted under 35 U.S.C. 154(b) by 211 days.

(21) Appl. No.: 12/425,242

(22) Filed: Apr. 16, 2009

(51) Int. Cl.
*B32B 3/08* (2006.01)
*B32B 3/10* (2006.01)

(52) U.S. Cl. ..... 428/43

(58) Field of Classification Search ..... 428/43, 428/76, 68; 15/209.1; 424/443–449
See application file for complete search history.

(56) References Cited

U.S. PATENT DOCUMENTS 3,954,554 A 5/1976 Curry et al.
4,046,622 A 9/1977 Attwood et al.
4,839,076 A * 6/1989 Willman et al. ..... 510/297
5,023,126 A 6/1991 Stevens et al.
5,397,435 A 3/1995 Ostendorf et al.
5,431,622 A * 7/1995 Pyrozyk et al. ..... 602/2
D377,284 S 1/1997 Farrow et al.
5,972,456 A 10/1999 Esquivel
D452,778 S 1/2002 Graff et al.

* cited by examiner

*Primary Examiner* — Alexander Thomas

(57) ABSTRACT

A paper product comprising a first layer being a strip of absorbent paper; a second layer comprising a wet component sandwiched between a first protective sheet and a second protective sheet, wherein the second layer is divided into individual flat packages that are removably attached to each other at an edge of the flat packages; and a third layer being a strip of absorbent paper; wherein the second layer is sandwiched between the first layer and the third layer; wherein the first layer, the second layer, and the third layer are embossed to form a weak bond between the respective layers in proximity to a perforation.

1 Claim, 13 Drawing Sheets

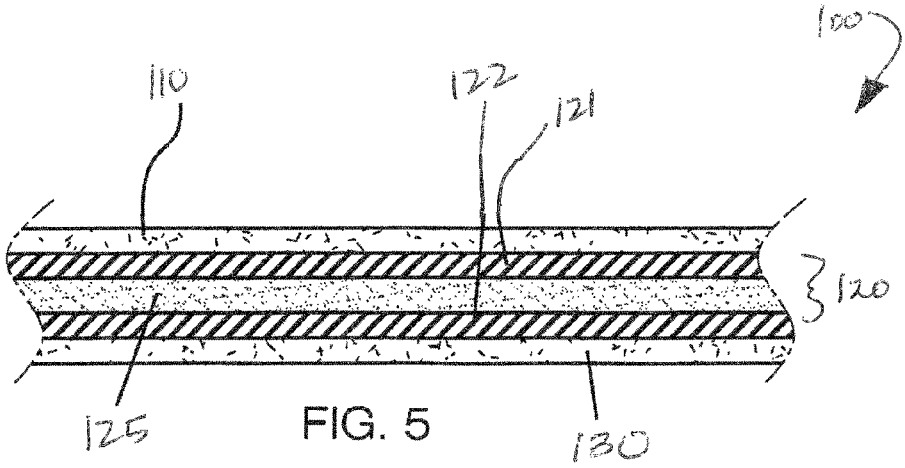
FIG. 5
FIG. 6
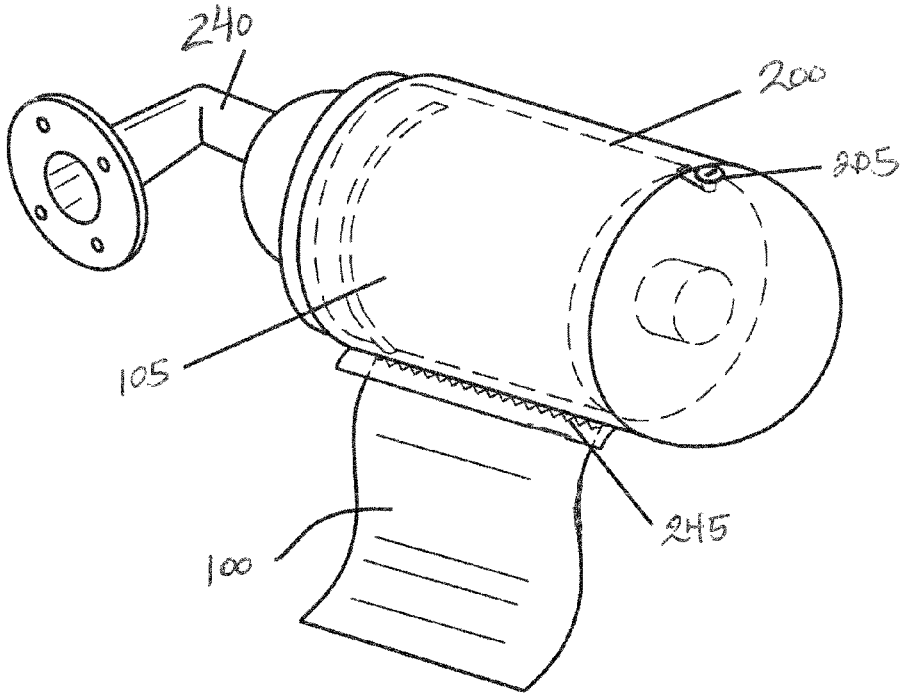

PAPER PRODUCT

FIELD OF THE INVENTION

The present invention is directed to a paper product, more particularly to a toilet paper product, napkin product, or paper towel product combining dry and wet sections for wiping and sanitizing.

BACKGROUND OF THE INVENTION

Paper products, for example bathroom tissue, paper towels, and napkins are generally two-ply paper products made from a dry paper material. These products are usually produced in rolls that can be loaded onto or into a dispenser. The present invention features a paper product comprising a wet layer sandwiched between two dry layers. The paper product of the present invention can be in the form of a toilet tissue, a paper towel, or a napkin. The present invention also features variations such as a paper product comprising a scrubbing pad.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 5 is a side cross sectional view of the paper product of FIG. 4.

FIG. 6 is a perspective view of the toilet paper form of the paper product.

DESCRIPTION OF PREFERRED EMBODIMENTS

Figure 1:
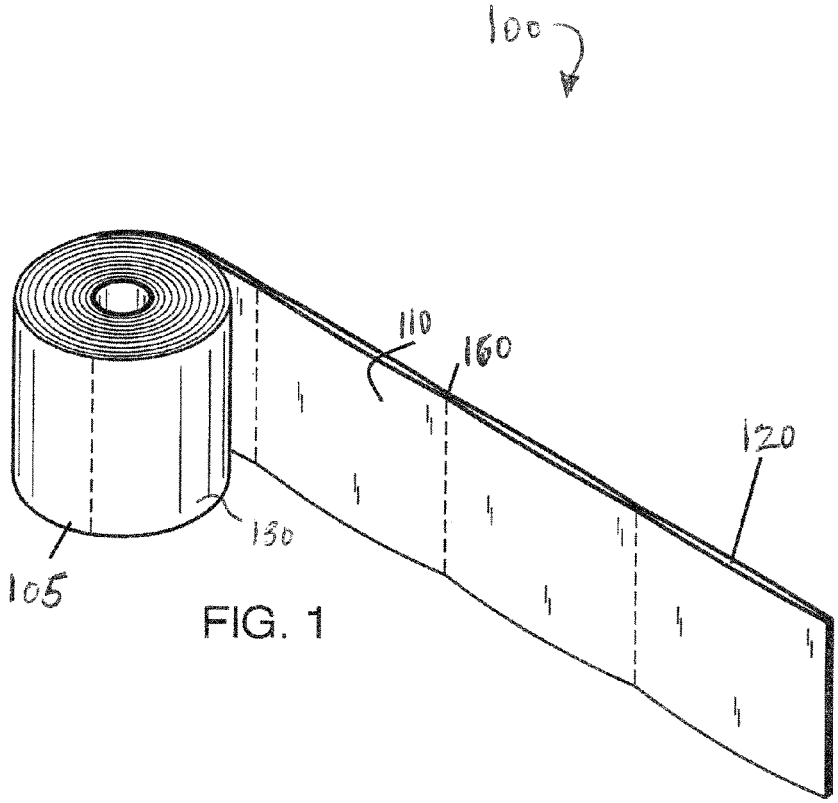
FIG. 1 is a perspective view of the paper product of the present invention.
Figure 2:
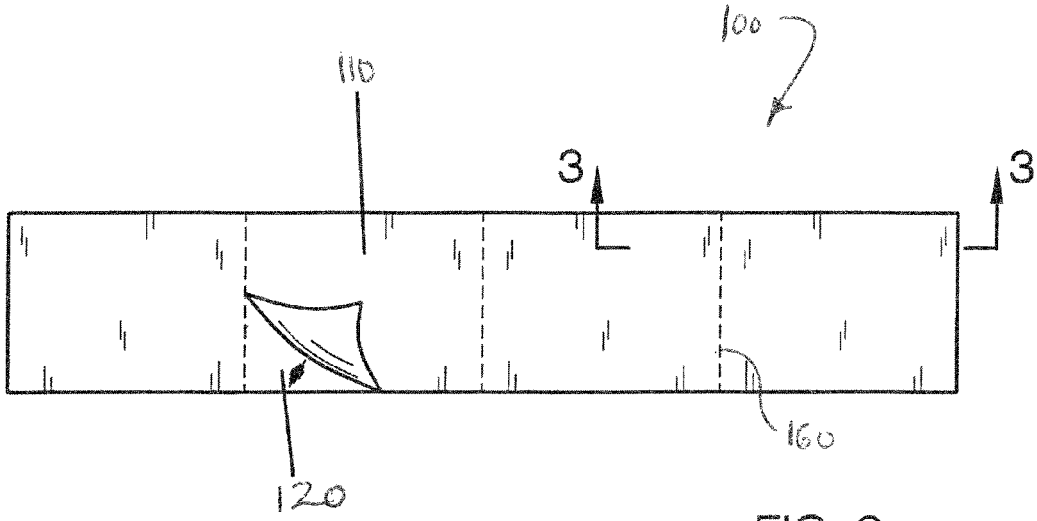
FIG. 2 is a front view of the paper product of FIG. 1.
Figure 3:
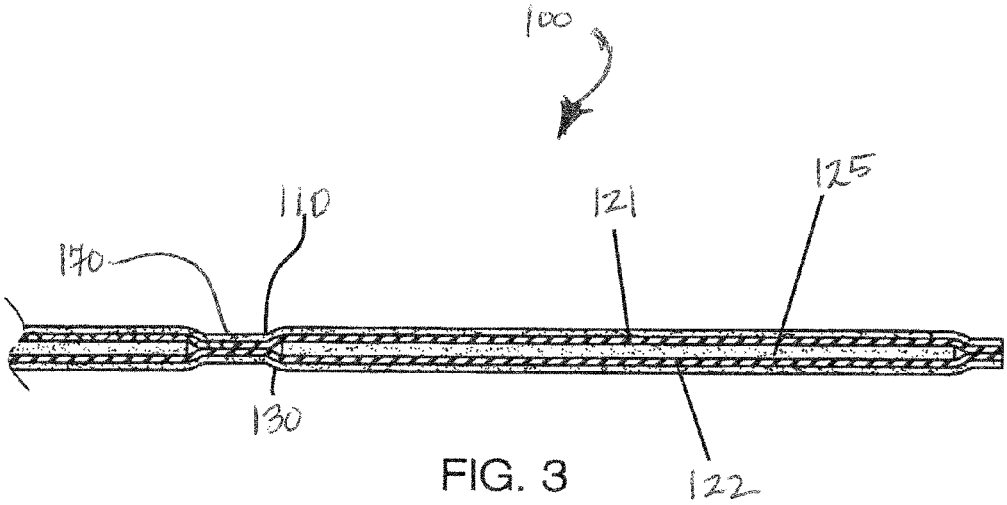
FIG. 3 is a side cross sectional view of the paper product of the present invention.
Figure 4:
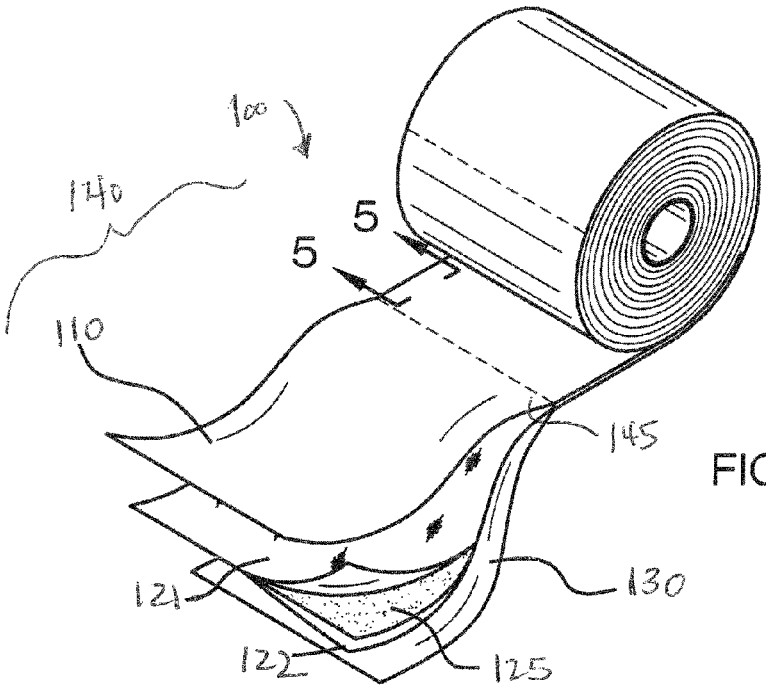
FIG. 4 is a perspective view of the paper product of the present invention.

The following is a listing of numbers corresponding to a particular element refer to herein:

100 paper product
105 roll
110 first layer
120 second layer
121 first protective sheet
122 second protective sheet
125 wet component
130 third layer
140 flat package
145 edge of flat package
160 perforation
170 embossing
200 toilet paper dispenser
205 lock
240 handle
245 cutting device
310 first half
320 second half
330 barrier
710 paper towel form of paper product
730 metallic material
760 bar
910 napkin form of paper product
940 storage container
950 wet napkin
960 dry napkin Referring now to FIGS. 1-14, the present invention features a paper product 100. The paper product 100 may be in toilet paper form, paper towel form, and/or napkin form. In some embodiments, the paper product 100 is designed to be a roll 105 (e.g., of toilet tissue, paper towels, napkins). Such rolls of paper products are well known to one of ordinary skill in the art.

Version 1: Multi-Ply Paper Product

As shown in FIGS. 1-5, the paper product 100 comprises a first layer 110 and a second layer 120. In some embodiments, the paper product 100 comprises a third layer 130. The second layer 120 is sandwiched between the first layer 110 and the third layer 130. In some embodiments, the first layer 110 is a dry layer. In some embodiments, the third layer 130 is a dry layer. In some embodiments, the first layer 110 and/or third layer 130 are strips of absorbent paper.

The second layer 120 (or flat package) comprises a wet component 125 sandwiched between a first protective sheet 121 and a second protective sheet 122. In some embodiments, the first protective sheet 121 and second protective sheet 122 can be peeled away from the wet component 125. The protective sheets may be constructed from a variety of materials. For example, in some embodiments, the protective sheets are constructed from a material comprising a plastic, a wax paper, a metal (e.g., aluminum) the like, or a combination thereof.

In some embodiments, the second layer 120 is divided into individual flat packages 140 that are removably attached to each other, for example at an edge 145 of the flat package 140 (e.g., a perforation 160). The flat package is for storing the wet component 125.

The paper product 100 of the present invention may be separated into units via a perforation 160. The separation of paper products into units with perforations is well known to one of ordinary skill in the art. In some embodiments, the first layer 110, second layer 120, and third layer 130 are embossed 170 to form a weak bond between each respective layer.

Embossing (e.g., quilting) is well known to one of ordinary skill in the art. In some embodiments, the paper product 100 is embossed 170 in proximity to a perforation 160.

Figure 6A:
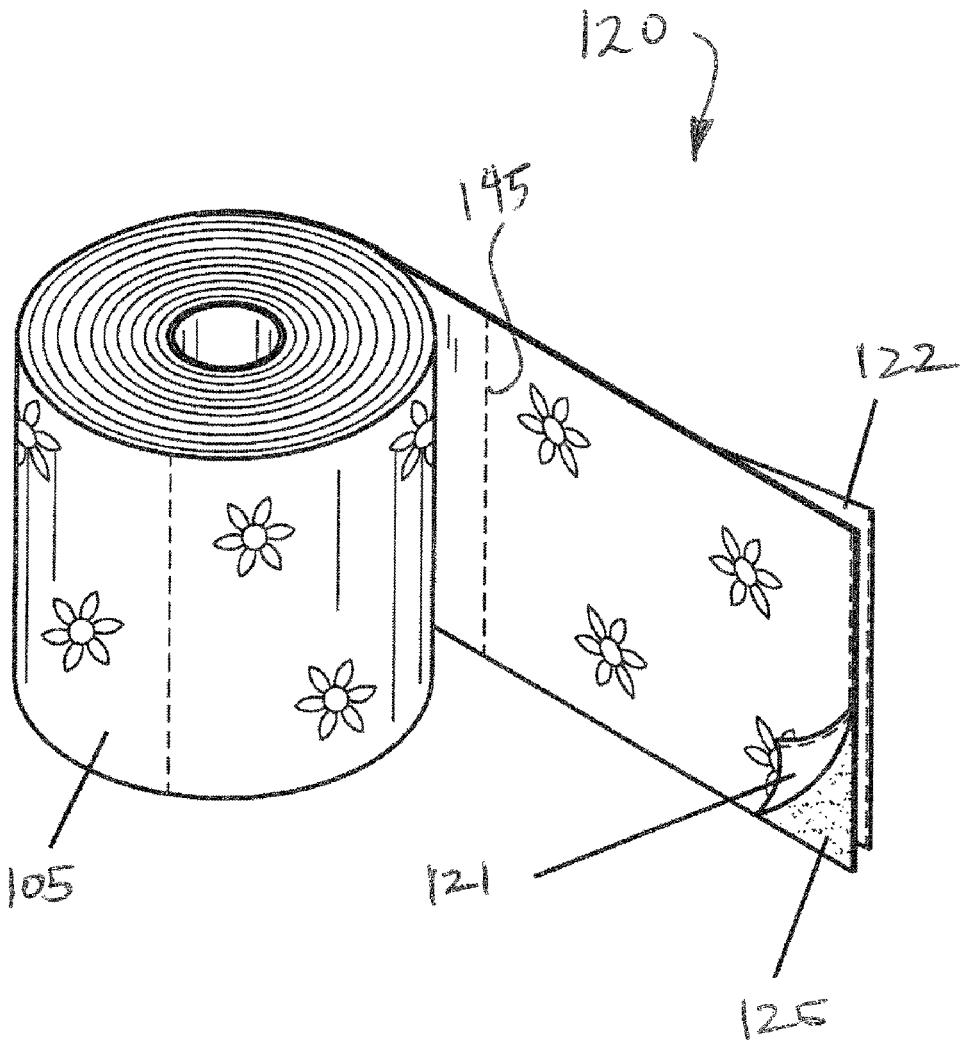
FIG. 6A is a perspective view of a roll of the second layer of the paper product.
Figure 7:
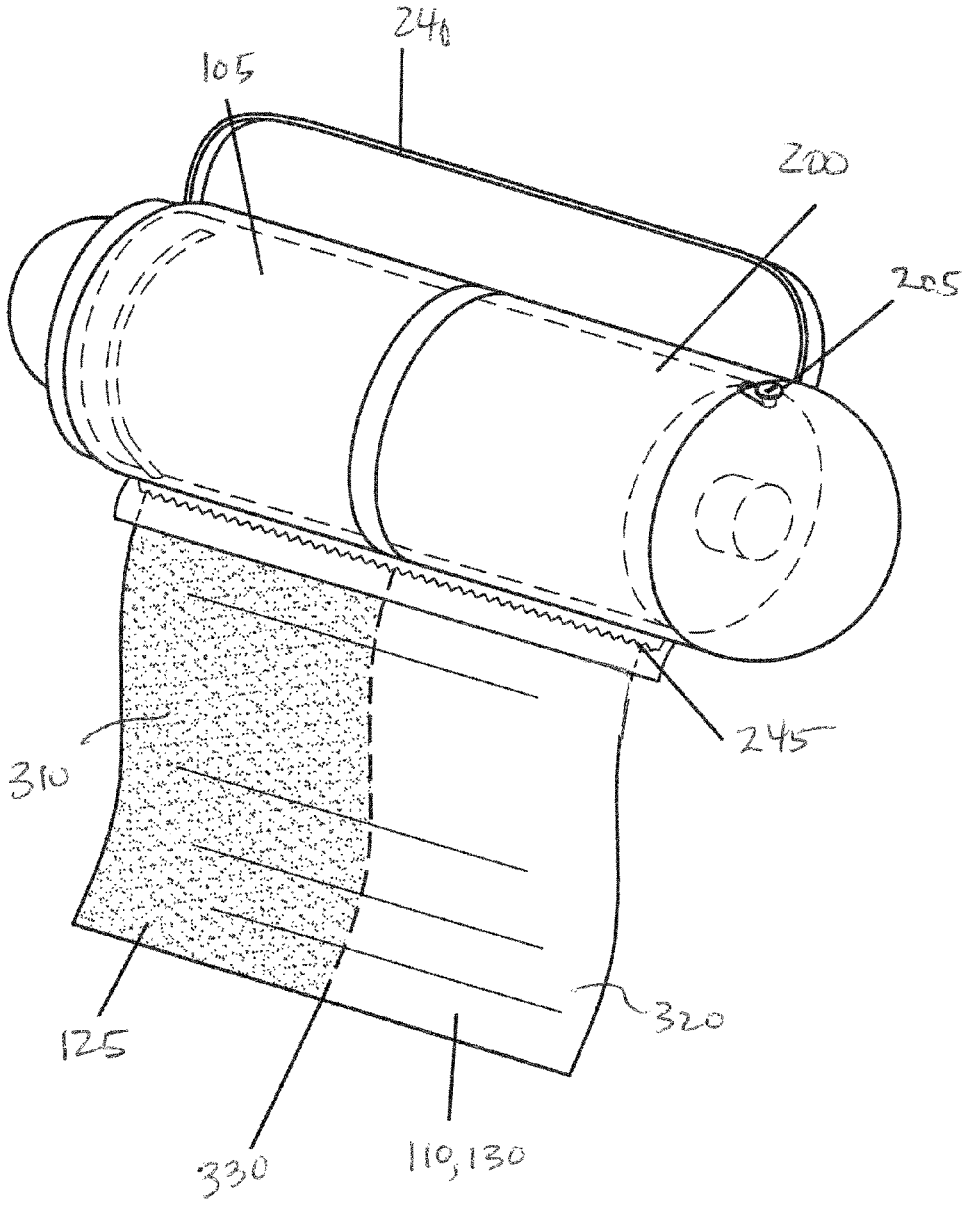
FIGS. 7 and 7A are perspective views of the paper product on a handle.
Figure 7A:
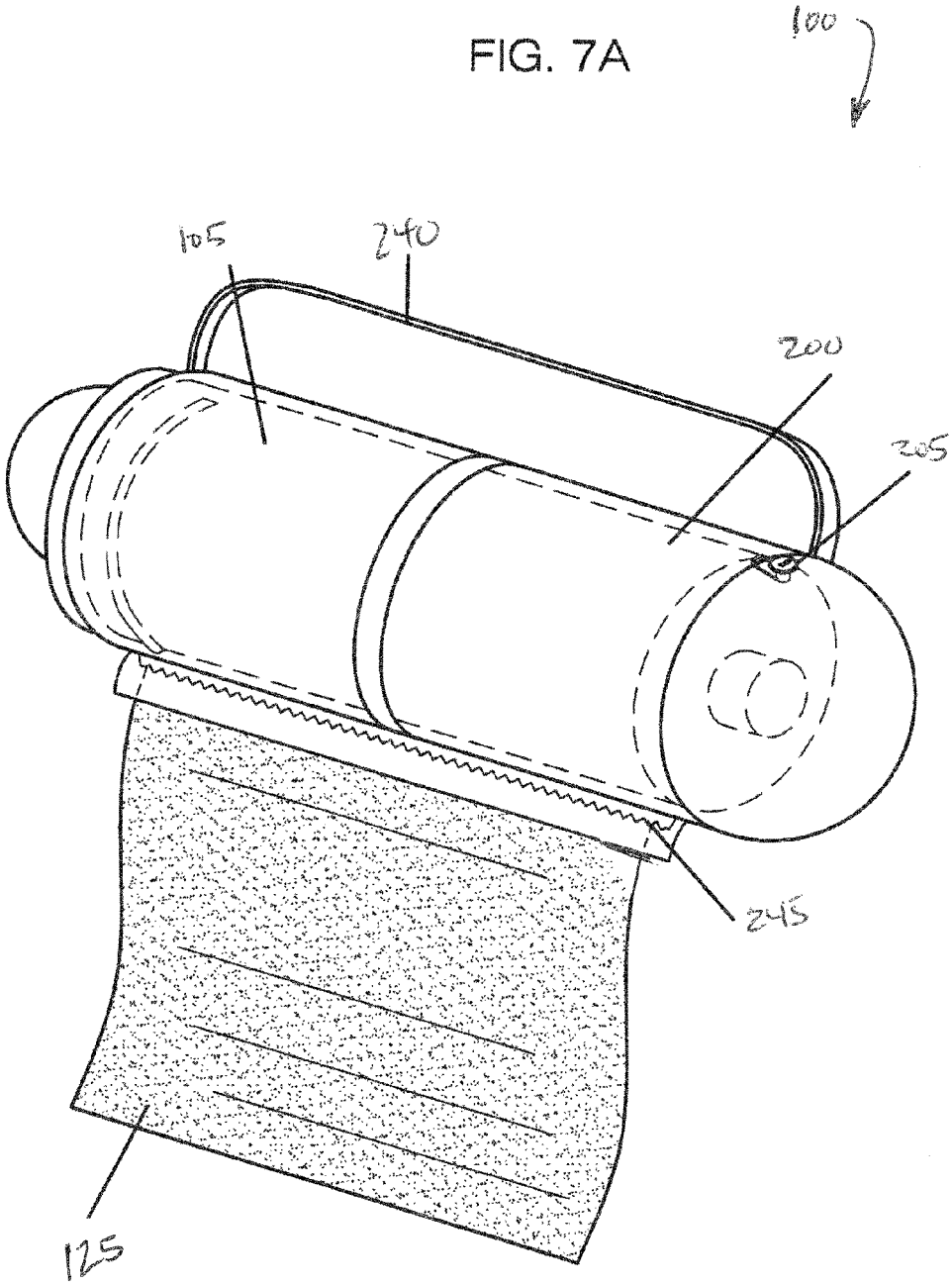
Figure 8:
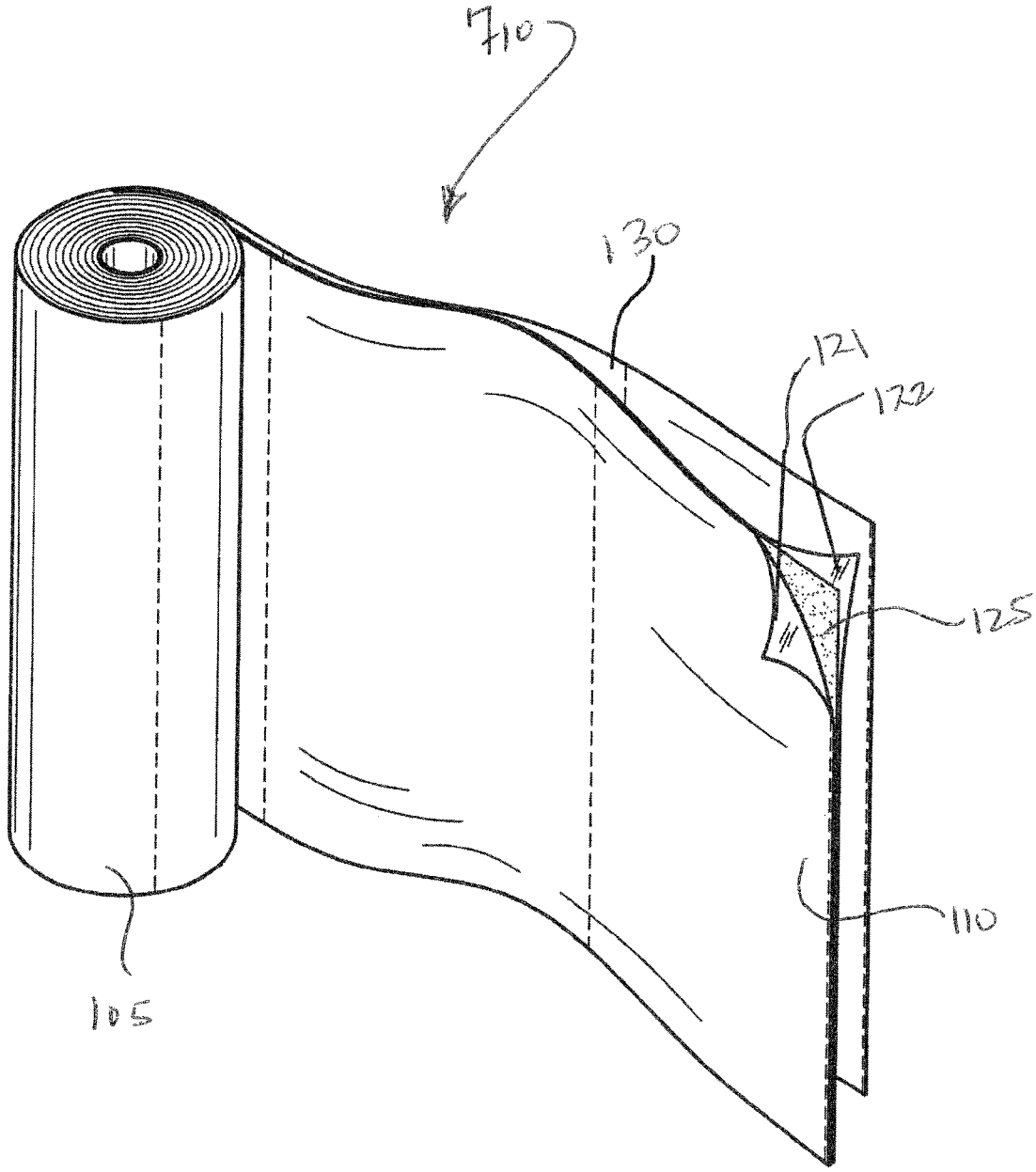
FIG. 8 is a perspective view of the paper towel form of the paper product of the present invention.
Figure 9:
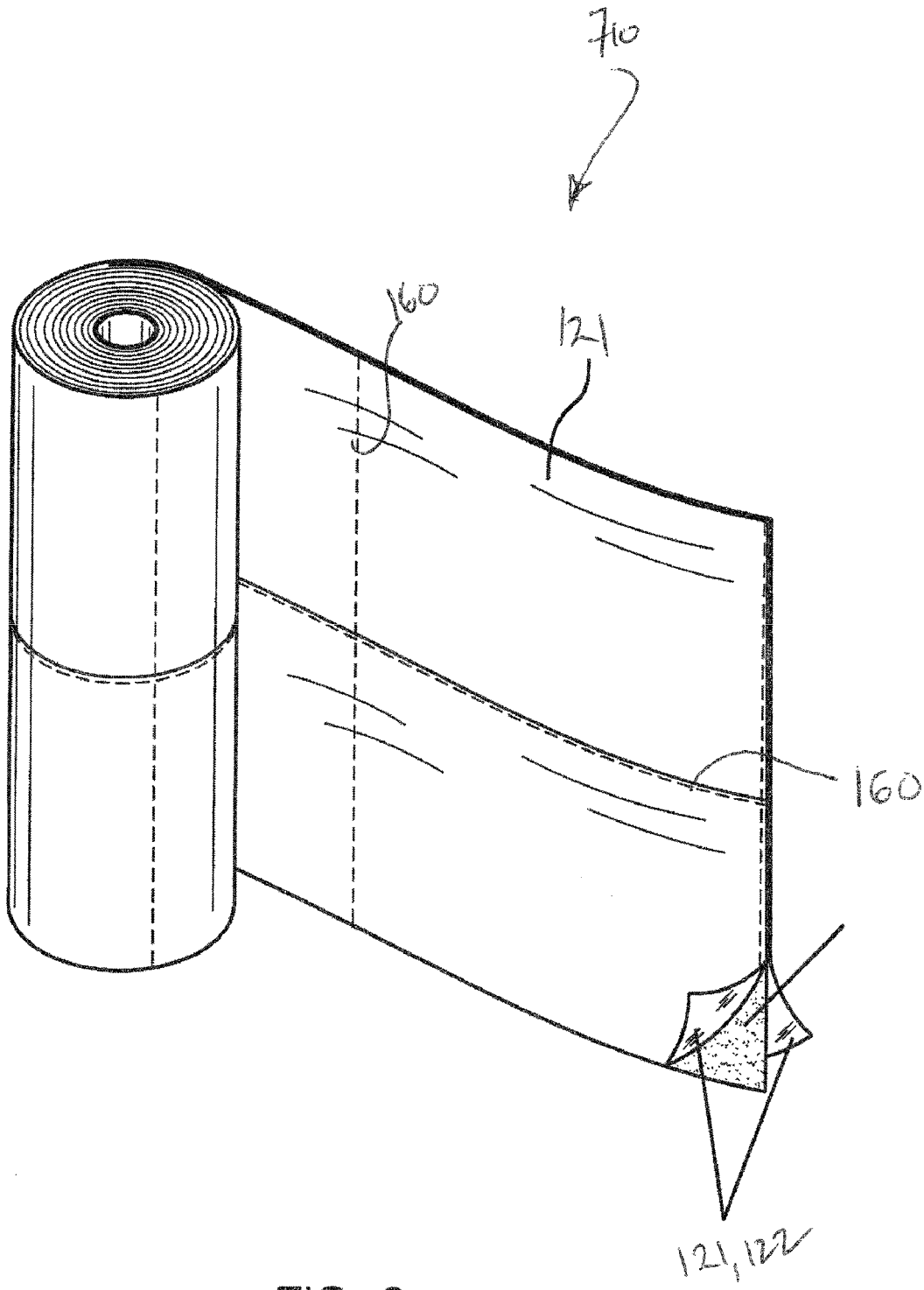
FIG. 9 is a perspective view of the paper product.
Figure 10:
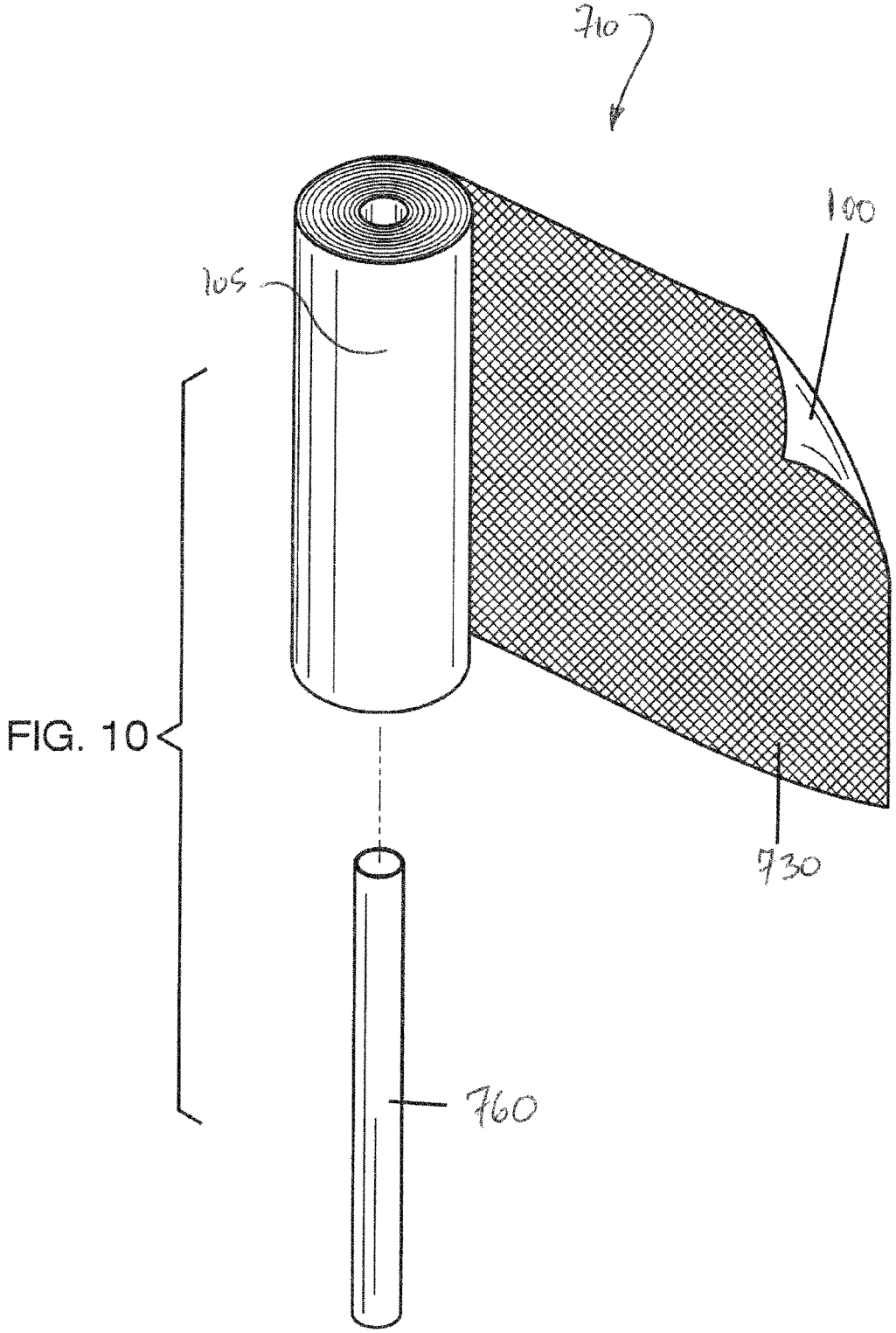
FIG. 10 is a perspective view of the paper product.
Figure 11:
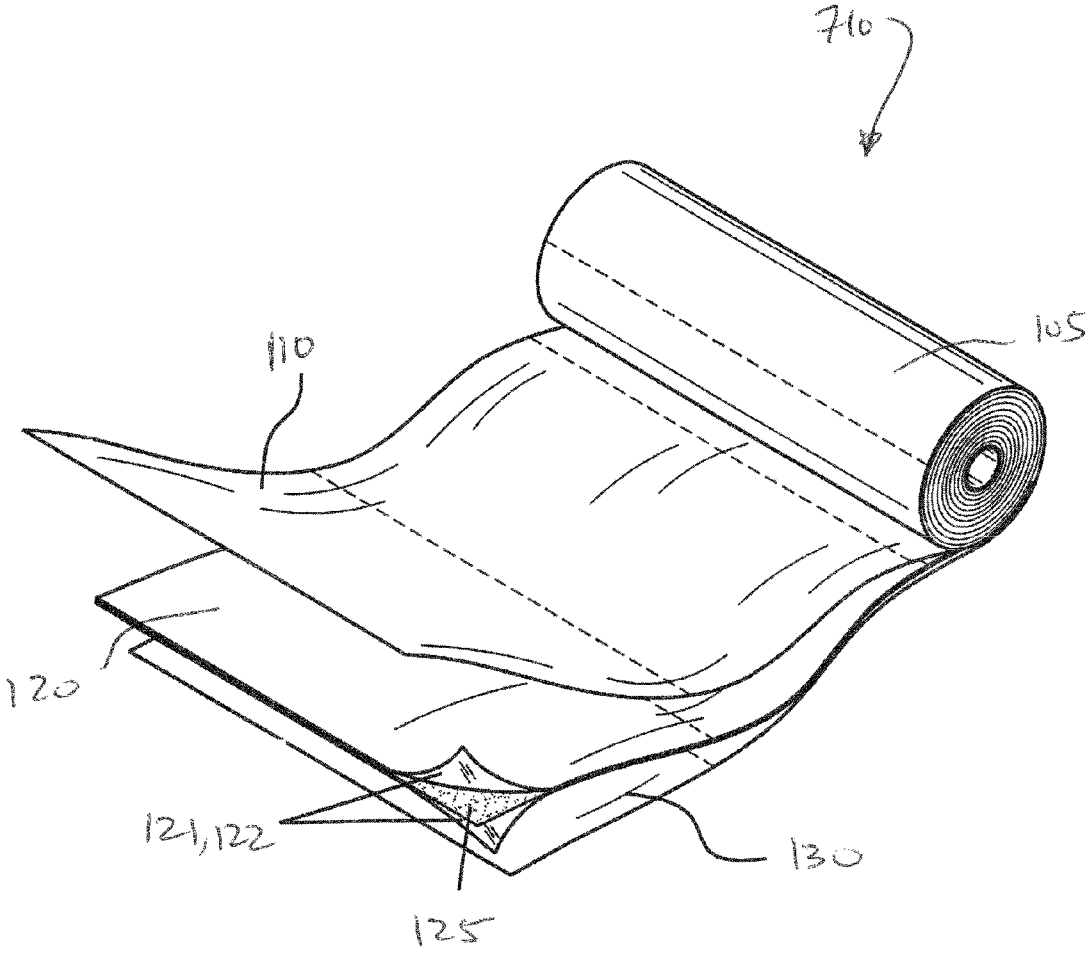
FIG. 11 is a perspective view of the paper product.
Figure 12:
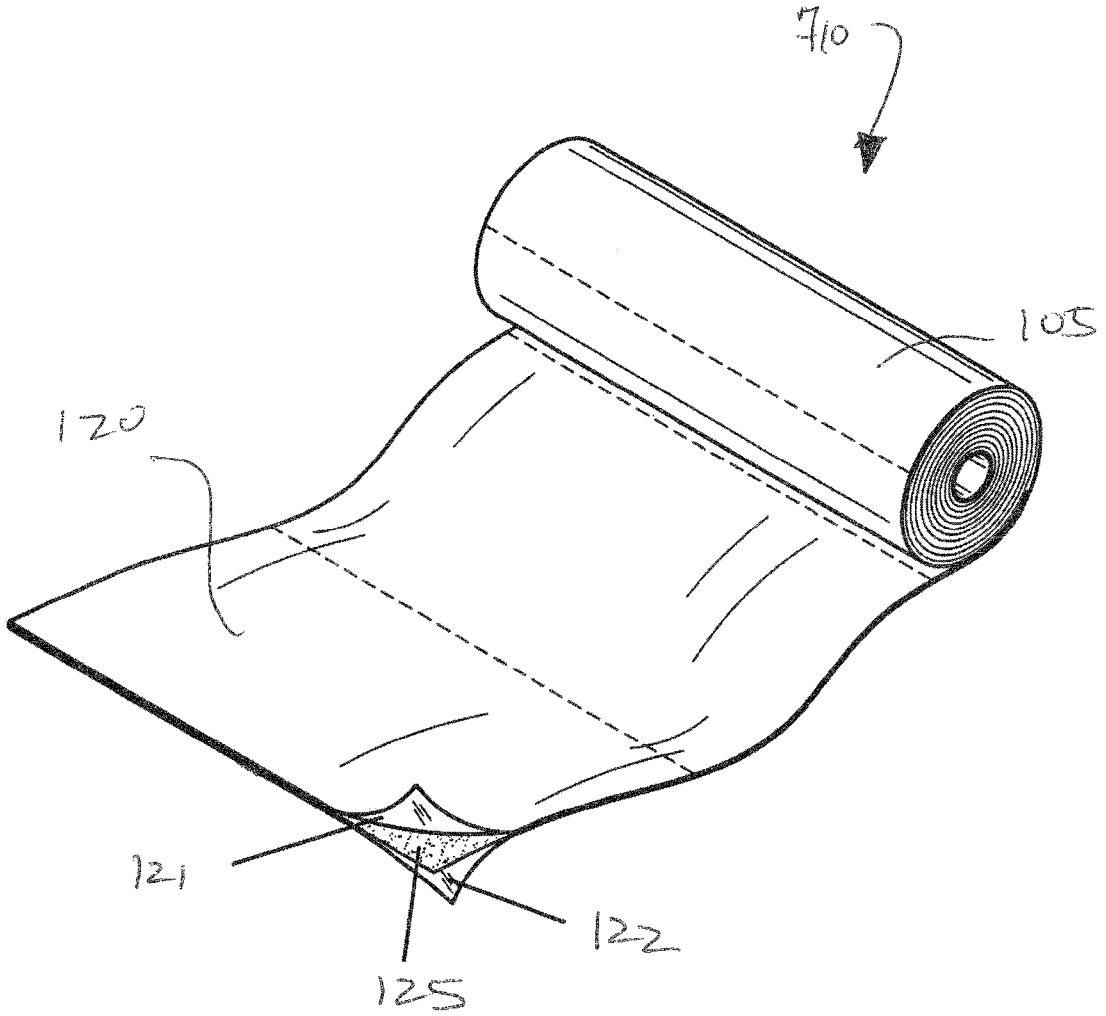
FIG. 12 is a perspective view of the paper product of the present invention.

As shown in FIG. 6, FIG. 7, and FIG. 7A, in some embodiments, the paper product 100 is in the form of a toilet tissue. The paper product 100 may be placed in or on a toilet paper dispenser 200. Toilet paper dispensers are well known to one of ordinary skill in the art. For example, the toilet paper dispenser 200 has a handle 240 for supporting the roll 105. In some embodiments, the toilet paper dispenser 200 comprises a lock 205 for helping to secure the roll 105 to the toilet paper dispenser 200. In some embodiments, the toilet paper dispenser 200 includes a cutting device 245 for helping a user tear off the paper product 100 from the roll 105.

As shown in FIG. 6A, in some embodiments, the paper product 100 is constructed in a roll 105 comprising the second layer 120 (e.g., the first protective sheet 121, the second protective sheet 122, and the wet component 125), without the first layer 110 and/or the third layer 130.

Version 2: Sectional Paper Product

As shown in FIG. 7, in some embodiments, the paper product 100 is constructed to have a first half 310 connected to a second half 320 via a barrier component 330. In some embodiments, first half 310 and second half 320 are separated via perforations 160. In some embodiments, the first half is the second layer 120. In some embodiments, the first half is the wet component 125. In some embodiments, the second half is the first layer 110 and/or the third layer 130.

As shown in FIG. 7A, in some embodiments, the paper product 100 is constructed in a roll 105 comprising the wet component 125, without the first protective sheet 121 and/or the second protective sheet 122 and/or the first layer 110 and/or the third layer 130.

As shown in FIGS. 8-12, the paper product 100 may be in a paper towel form 710. In some embodiments, the paper product is arranged in a roll, similar to a roll of paper towels. The paper towel form 710 may be placed on a dispenser, such as a bar 760. Paper towel dispensers are well known to one of ordinary skill in the art. In some embodiments, the paper towel form further comprises a layer of metallic material 730.

Figure 13:
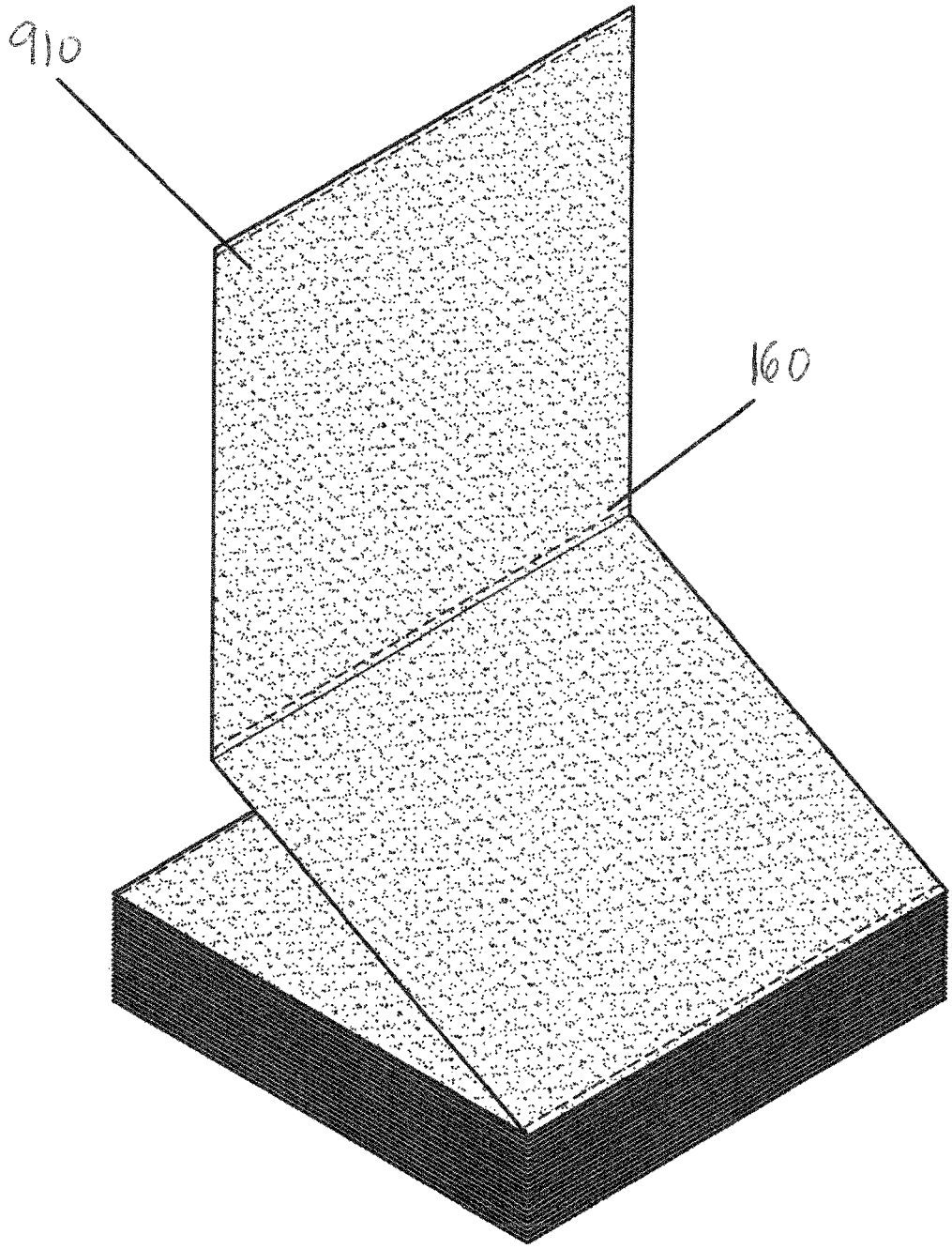
FIG. 13 is a perspective view of the paper product of the present invention, wherein the product is in the form of a napkin.
Figure 14:
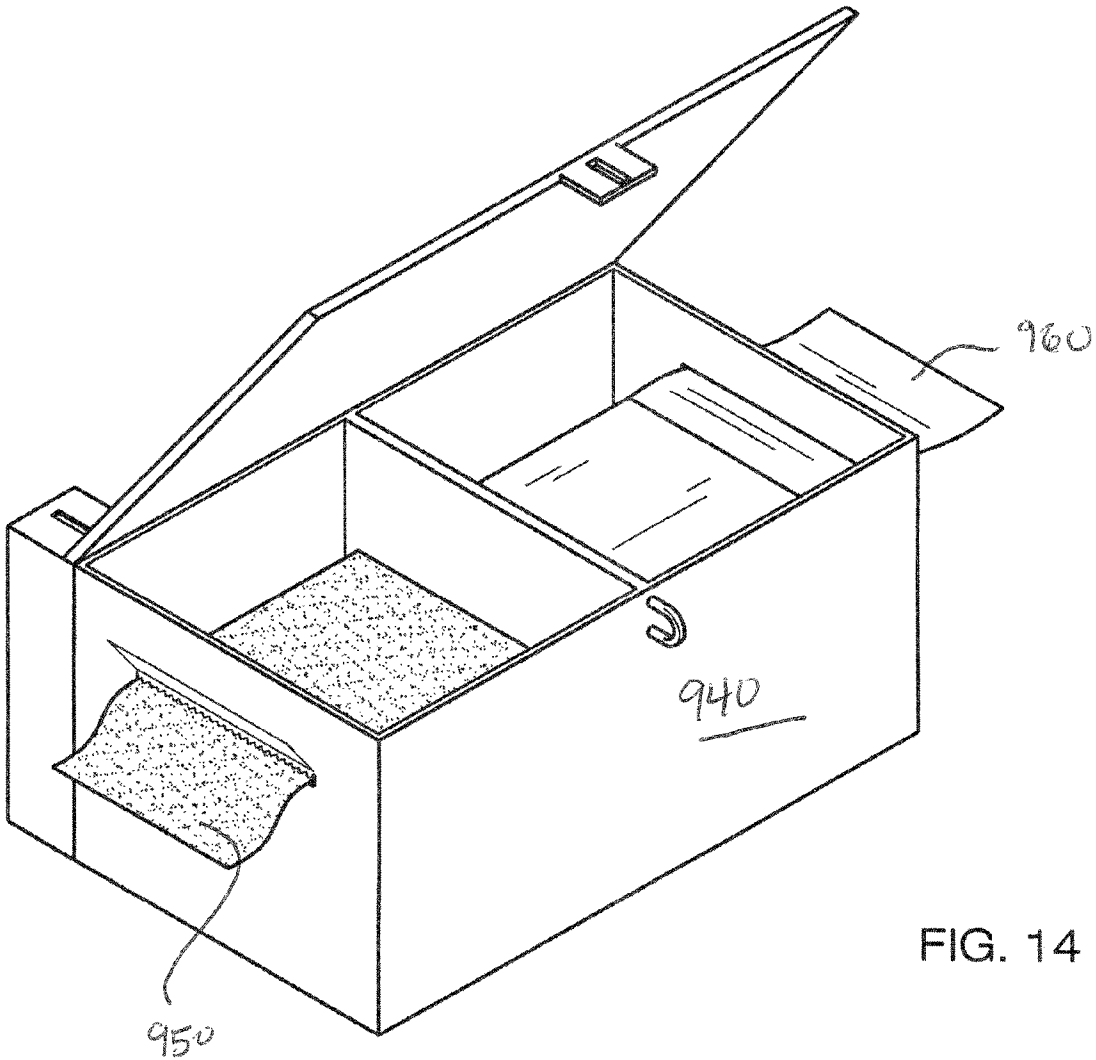
FIG. 14 is a perspective view of the napkin form of the paper product, wherein the product is stored in a storage container.

As shown in FIGS. 13-14, the paper product 100 may be in a napkin form 910. In some embodiments, the napkin 910 is a wet napkin 950 or a dry napkin 960. In some embodiments, the napkins 910 may be connected together and separated via a perforation 160. In some embodiments, the napkins can be stored in a storage container 940.

Version 3: Scrubbing Paper Product

In some embodiments, the paper product 100 comprises a first layer 110 atop a second layer 120. In some embodiments, the first layer 110 is a wet layer comprising a wet component and the second layer 120 is a scrubbing pad, for example similar to a scratch-free scrubbing pad. Such scratch-free scrubbing pads are well known to one of ordinary skill in the art. The scrubbing pad is for helping clean tough stains and hard surfaces. The first layer 110 and/or second layer 120 can be of various sizes and thicknesses, according to a user's needs.

The paper product 100 of the present invention may be separated into units via a perforation 160. The separation of paper products into units with perforations is well known to one of ordinary skill in the art.

Version 4: Single-Ply Paper Product

In some embodiments, the paper product 100 comprises a first layer 110 and the first layer 110 is a wet layer comprising a wet component. The paper product 100 of the present invention may be separated into units via a perforation 160. The separation of paper products into units with perforations is well known to one of ordinary skill in the art.

The paper product 100 of the present invention may be constructed in a variety of sizes. In some embodiments, the paper product 100 is divided into units separated by a perforation 160. In some embodiments, the units of the paper product 100 are between about 3 to 4 inches in length as measured from a first edge to a second edge, in some embodiments, the units of the paper product 100 are between about 4 to 5 inches in length as measured from the first edge to the second edge. In some embodiments, the units of the paper product 100 are between about 5 to 7 inches in length as measured from the first edge to the second edge. In some embodiments, the units of the paper product 100 are more than 7 inches in length.

In some embodiments, the units of the paper product 100 are between about 2 to 3 inches in width as measured from a third edge to a fourth edge. In some embodiments, the units of the paper product 100 are between about 3 to 4 inches in width as measured from the third edge to the fourth edge. In some embodiments, the units of the paper product 100 are between about 4 to 5 inches in width as measured from the third edge to the fourth edge. In some embodiments, the units of the paper product 100 are more than about 5 inches in width.

As used herein, the term "about" refers to plus or minus 10% of the referenced number. For example, an embodiment wherein a unit is about 5 inches in width includes a unit that is between 4.5 and 5.5 inches in width.

In some embodiments, the first layer 110 and third layer 130 are both constructed from a material comprising a paper that is appropriate for use in a toilet. The composition of paper that is appropriate for use in a toilet is well known to one of ordinary skill in the art. For example, the paper must be thin enough to break down in a sewage system. In some embodiments, the first layer 110 and third layer 130 are constructed from a material comprising a paper that is appropriate for use as a paper towel. The composition of paper that is appropriate for use as a paper towel is well known to one of ordinary skill in the art. For example, the paper must be sturdy enough so as not to break down when contacted with a liquid.

The wet component 125 may be constructed from a variety of materials. In some embodiments, the wet component 125 is constructed from a material comprising water, ethanol, isopropanol, glycerin, propylene glycol, acetic acid, isopropyl myristate, tocopherol acetate, aminomethyl propanol, the like, or a combination thereof. In some embodiments, the wet component 125 may be constructed from a material comprising an antibacterial composition, a scented composition, a water-based composition, the like, or a combination thereof.

The following the disclosures of the following U.S. Patents are incorporated in their entirety by reference herein: U.S. Pat. No. 5,972,456; U.S. Pat. No. 5,023,126; U.S. Pat. No. 3,954,554; U.S. Pat. No. 5,023,126; U.S. Pat. No. 4,046,622; U.S. Pat. No. 4,046,622; U.S. Pat. No. 5,397,435.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A paper product comprising a first layer divided into a first half and a second half separated via perforations, wherein the first half comprises a wet component sandwiched between a first protective sheet and a second protective sheet, wherein the second half is a strip of absorbent dry paper, and further wherein the first and second protective sheets are constructed of wax paper.

* * * * *